US011235842B2

(12) United States Patent
Groeneweg

(10) Patent No.: US 11,235,842 B2
(45) Date of Patent: Feb. 1, 2022

(54) WATERCRAFT STABILIZING DEVICE FOR PERSONNEL BOARDING OR EXITING

(71) Applicant: Art Groeneweg, Laclede, ID (US)

(72) Inventor: Art Groeneweg, Laclede, ID (US)

( * ) Notice: Subject to any disclaimer, the term of this patent is extended or adjusted under 35 U.S.C. 154(b) by 76 days.

(21) Appl. No.: 16/879,150

(22) Filed: May 20, 2020

(65) Prior Publication Data

US 2020/0369347 A1 Nov. 26, 2020

Related U.S. Application Data

(60) Provisional application No. 62/852,084, filed on May 23, 2019.

(51) Int. Cl.

| | |
|---|---|
| ***B63B 27/14*** | (2006.01) |
| ***B63B 34/26*** | (2020.01) |
| ***B63B 39/00*** | (2006.01) |

(52) U.S. Cl.

CPC ..... *B63B 27/14* (2013.01); *B63B 39/00* (2013.01); *B63B 34/26* (2020.02)

(58) Field of Classification Search

CPC ..... B63B 27/14; B63B 27/143; B63B 27/146; B63B 2027/141; B63B 39/00; B63B 34/26; B63B 35/34; B63B 7/085; B63B 7/087

USPC ..... 114/362, 364

See application file for complete search history.

(56) References Cited

U.S. PATENT DOCUMENTS

| | | | | |
|---|---|---|---|---|
| D384,480 | S | 9/1997 | Patterson | |
| 6,021,733 | A * | 2/2000 | Jaramillo, Sr. | B63B 27/146 114/362 |
| 6,962,122 | B1 | 11/2005 | Bouldin, Jr. | |
| 7,444,954 | B1 * | 11/2008 | Resta | B63B 27/143 114/362 |
| 7,735,444 | B1 * | 6/2010 | Fox | B63B 27/19 114/362 |
| 7,966,962 | B1 | 6/2011 | Fox | |
| D652,781 | S | 1/2012 | Steckline | |
| 8,137,028 | B2 | 3/2012 | Wrobbel | |
| 8,381,673 | B2 | 2/2013 | Wirsig | |
| 8,915,207 | B2 | 12/2014 | Wirsig | |
| 9,592,893 | B2 | 3/2017 | Kroeger et al. | |
| 10,145,073 | B2 | 12/2018 | Levin | |
| 10,315,738 | B2 | 6/2019 | Imel et al. | |
| 10,507,892 | B2 * | 12/2019 | Carter | B63B 21/00 |
| 2012/0199059 | A1 | 8/2012 | Spitzack | |
| 2019/0063024 | A1 | 2/2019 | Levin | |

* cited by examiner

*Primary Examiner* — Anthony D Wiest

(74) *Attorney, Agent, or Firm* — Berenato & White, LLC

(57) ABSTRACT

Disclosed is a device that engages and stabilizes a personal watercraft for boarding or exiting. The device simultaneously engages upper surface elements of the watercraft whilst also providing firm land/pier engaged support to the user. A user's weight is able to bear against the inherent buoyancy of the watercraft through a structure rotated downwardly to the watercraft; the rotated structure is hinged and fixed to the land/pier. During entry, the upwardly urging buoyancy of the watercraft stabilizes the watercraft against the downwardly rotated structure while a user steps from the land/pier to the watercraft and fully transfers weight to the watercraft. Exit is the reverse. A method of associated use is also disclosed.

8 Claims, 10 Drawing Sheets

WATERCRAFT STABILIZING DEVICE FOR PERSONNEL BOARDING OR EXITING

This application claims the benefit of prior filed provisional application Ser. No. 62/852,084, filed May 23, 2019.

BACKGROUND

1. Field of the Invention

The invention relates generally to boarding and exiting small, narrow beam, watercraft. More particularly, the invention relates to providing a personal stabilizing device for both an individual and the watercraft for boarding or exiting.

2. Background

Currently there are few solutions for boarding and exiting kayaks and other small watercraft that do not require considerable personal confidence, balance, and dexterity. Some of these solutions attempt to stabilize the craft, but these solutions fail to meet the needs of the users because they do not address the stability of the individual(s) and watercraft simultaneously. Other solutions are larger, more cumbersome and are, accordingly, very costly. Known solutions also fail to meet users' needs because they often incorporate modifications to a unit typically intended for heavier powered watercraft, i.e., a jet ski or boat lift. These modifications restrict its original use, take up even more area, and still are very difficult to use. There are no devices that attempt to address the issue of boarding unstable personal watercraft safely, with confidence, and which are compact and transferable location to location.

SUMMARY OF THE INVENTION

It is desirable to have both a stabilized watercraft and stabilized person alighting or exiting the watercraft, simultaneously. Furthermore, it is desirable to have a person board a watercraft safely and confidently inasmuch as this encourages and promotes use. Still further, it is desirable to have a way that users will not get injured or overturn watercraft in the water during the process of boarding or exiting the watercraft. There is no easy, simple or safe way for many individuals, particularly first-time users or those with certain disabilities, to mount a small watercraft. Gaining initial stability is extremely difficult, particularly when one lacks confidence that it can be done. The disclosed device provides a mechanism to make this more approachable, less scary, and achievable. The disclosed device advantageously fills these needs by providing users a way to get onto/into a watercraft safely without getting injured or wet, or both.

Disclosed is a personal and watercraft stabilizing device for boarding and exiting the watercraft, which is made up of the following components: a pier/land hinge mount, a frame having a right side, left side, top and bottom, with the right and left sides being relatively vertical from top to bottom, with feet that protrude further down from the right and left sides beyond the bottom part of the frame. On one side of the frame near the bottom, approximately in-line with a lower horizontal portion of the frame, is an extended element off to one side that has the complementary hinge mount to engage the pier/land hinge mount. These respective hinge components are connected, for example, by a removable pin with a safety clip. The respective hinge mounts, one on the frame connected to the hinge mount attached to the land/dock to stabilize it and enable it to rotate from an up position to a down position; with an approximate preferred 90 degree swing between stowed to full use position.

The device may also have one or more of the following optional features: adjustable feet/legs that accommodate varying levels of watercraft upper surface contact heights above the waterline. The adjustable legs/feet would include an offset on each leg that would allow a fixed amount of narrowing or widening where the feet make contact to the watercraft by means, for example, of a small pin and manually adjusting the legs by extending and/or rotating them and re-pinning them to a different hole in a surrounding collar or pipe length. Another optional feature would be an arm, that connects the frame to the hinge point at the dock, being adjustable so as to get closer or further away from the dock, as well as including the ability to turn the rectangular frame 90 +/−degrees and re-pin it and rotate the unit upward so it would be out of the way, more-or-less parallel with the docks edge when stowed. There is also an optional pad that goes onto a lower portion of the frame to provide a cushion to the knees for the purpose of aiding in the process of boarding to sit or when pulling up to standing position when exiting watercraft.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The device may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

The present invention is directed to personal watercraft stabilizing device for boarding and exiting the watercraft.

Figure 1:
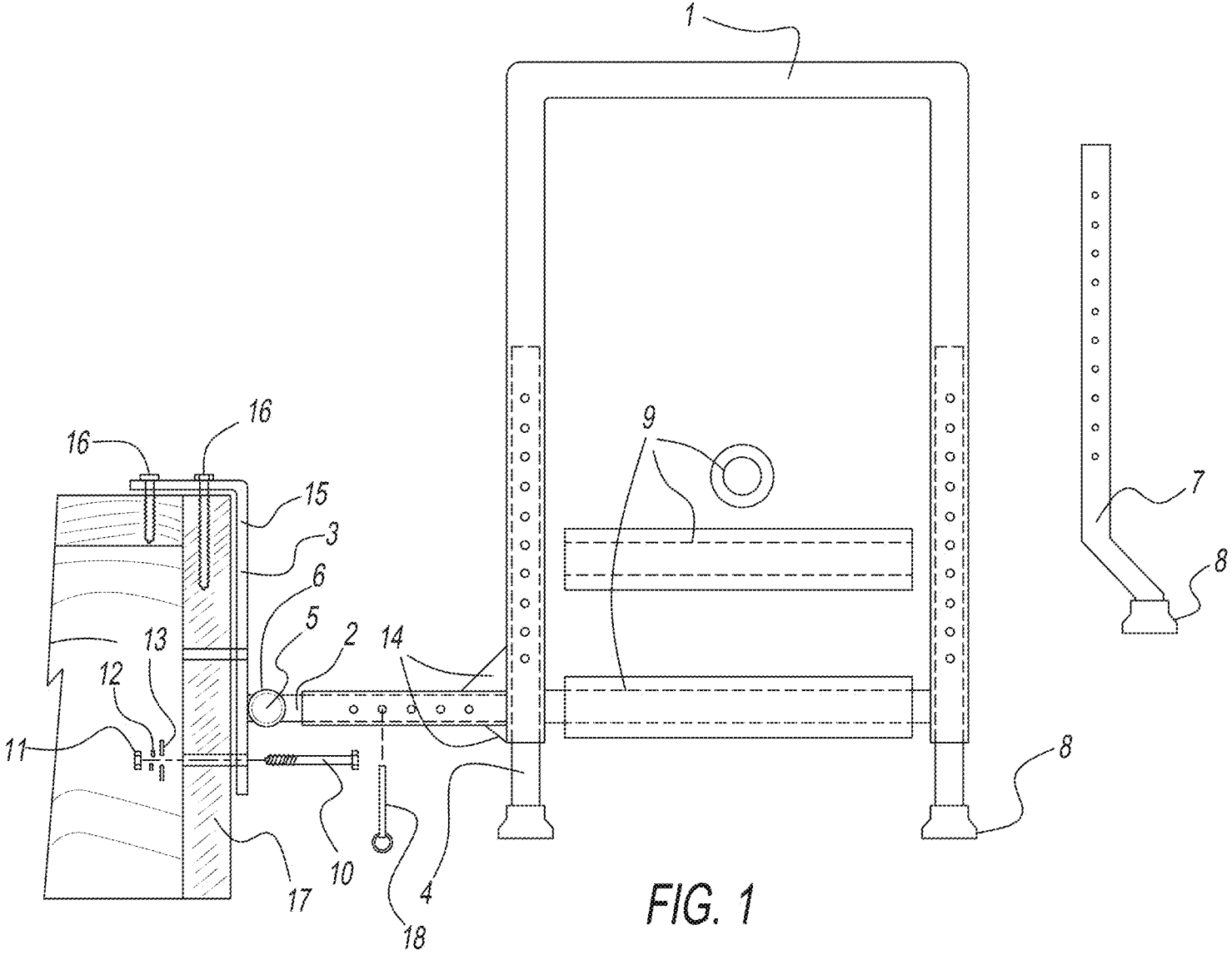
FIG. 1.—is a partial sectional side view of a watercraft stabilizing and boarding/exiting device in accord with the present invention.
Figure 2:
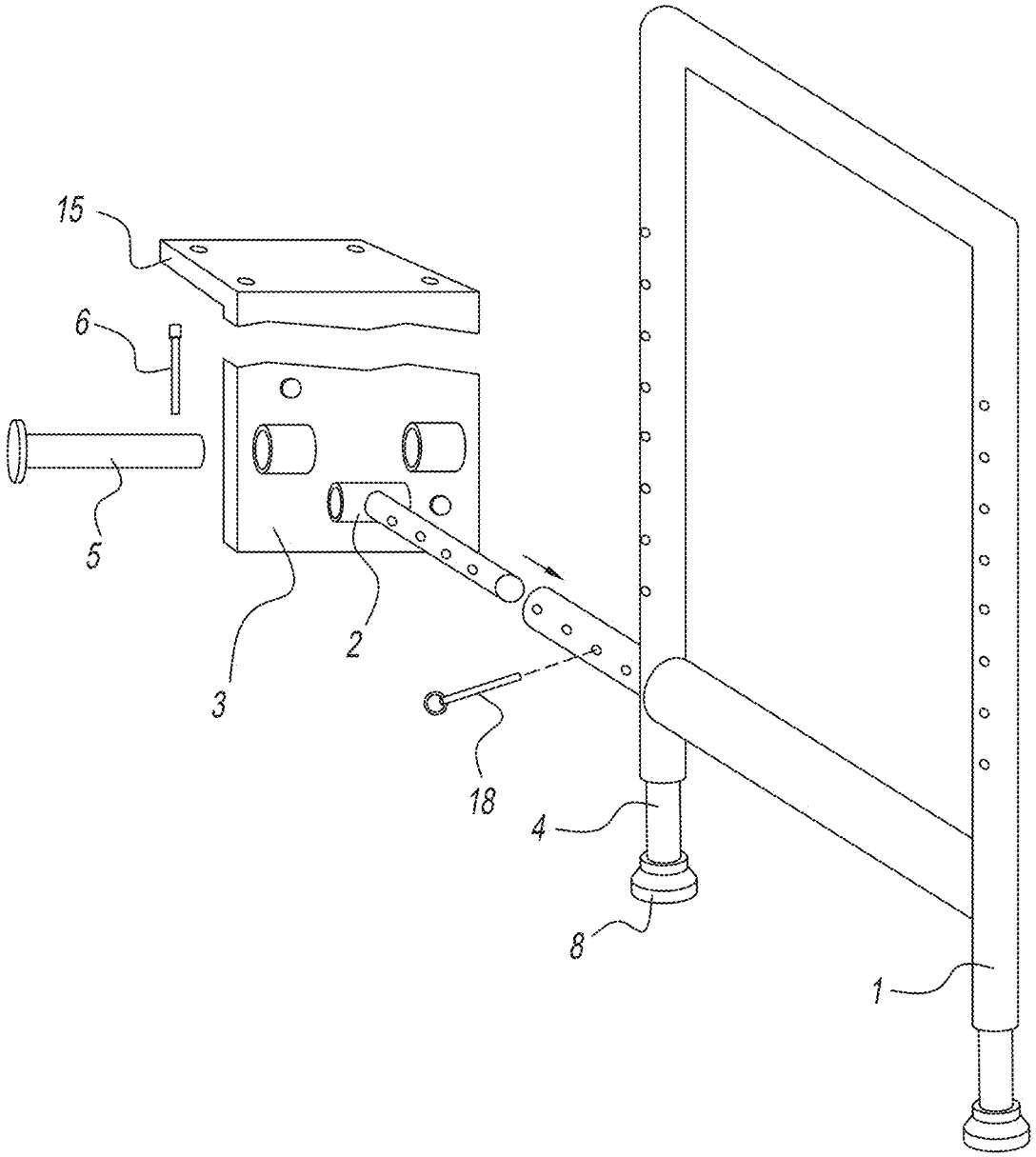
FIG. 2.—is an oblique partially exploded view of the device shown in FIG. 1.
Figure 3:
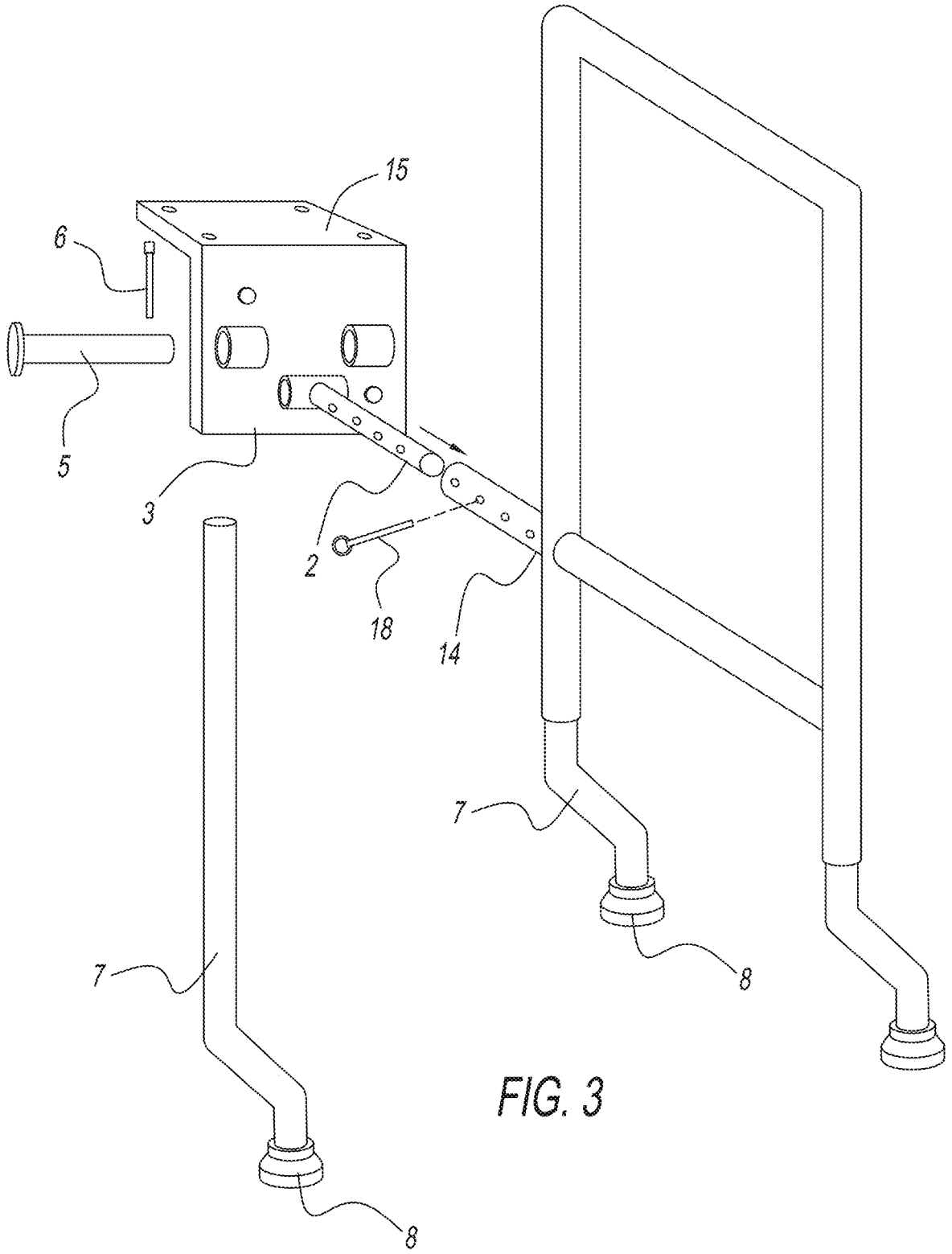
FIG. 3.—is a second oblique partially exploded view of the device shown in FIG. 1 with offset legs/feet.

With general reference to FIGS. 1-3: In a preferred embodiment, the device is made up of the following components, one bolt-on hinge plate (3) attached to the dock, or other solid, structure (17), one hinge pin (5) with a safety cotter pin (6), one rectangular shaped frame (1) with parallel sides and parallel top and bottom, with feet (8) on legs (4)

extending past the attaching bar that are preferably adjustable by lengthening them and/or turning the offset legs (7) 90 degrees to either narrow or widen their stance to make contact with the watercraft's upper surface shape. The hinging arm (2), inserted into the lower end of the main rectangular structure (1), is also preferably adjustable in two ways: first to increase or decrease the distance between the dock and main rectangular frame by removing and replacing the safety/adjusting pin (18) into different holes to accommodate the approximate centerline of the watercraft's design width; and, second to be able to rotate the rectangular frame approximately 90 degrees parallel with the docks edge so that it does not impede the dock's deck space. The lower bottom bar, between the right and left sides of the main rectangular structure (1), is where knees or shins brace against the padded bar (9) to assist in (while holding onto the top bar with both hands) sitting down or kneeling (while boarding) or pulling up to a standing position (preparing to exit) while aboard the watercraft. These components are connected with pins (5), (18). By holding the rectangular frame (1) with the hinging arm (2) inserted into it, the safety/adjusting pin (18) is installed and lined up with the half hinge that is securely mounted onto the dock, followed by inserting the pin (5) and the safety securing cotter pin (6). It should further be noted that: when connecting the half hinge bracket (3) with the two holes to the dock will require either two bolts (10) with washers, lock washers (13, 12) and nuts (11) or two lag bolts (16) depending upon the material (wood, metal, composite, etc.) of the dock structure itself.

FIG. 1 is a side perspective view illustrating one embodiment of the present invention mounted to a solid structure such as a dock (floating or fixed, or the back of a large boat). The various components of this preferred embodiment with all its different parts and optional pieces listed herein include: 1)—the main support structure, can be built from either round, square, rectangular, octagonal, hexagonal, or triangular tube of various types of metal, alloys, solid or hollow plastics, wood, hemp, composites, fiberglass, or paper of various sizes and dimensions. Although mainly rectangular overall, the frame can be built with rounded, angled or multiple angled topside, can be made taller or narrower, wider or shorter, larger or smaller etc. The main structure has a hinging arm. The hinging arm (2) could be configured to be a part of the main rectangular structure as a whole, i.e., monolithic or firmly attached, and that connects directly to the hinge plate (3). The optionally adjustable version has adjustable legs (4, and 7) and an adjustable, lengthwise, hinging arm (2).

FIG. 2.—is an oblique angle view of a preferred embodiment indicating how the hinging arm (2) inserts into main structure (1) and is safety pinned (18). The arm (2) is connected to the hinge plate (3) with hinge pin (5) and with cotter pin (6) to keep the hinge pin (5) in place. The hinge plate (3) is shown separated from, or if needed, an auxiliary mounting plate (15). This version is shown with adjustable straight legs/feet (4).

FIG. 3.—is an oblique angle view of the same embodiment as in FIG. 2, but shows the embodiment with offset legs/feet (7) for watercraft that require narrower, wider or albeit further wide out stance that cannot be achieved by extending the horizontal hinging arm (2) and main rectangular structure any further from the hinge plate.

Figure 4:
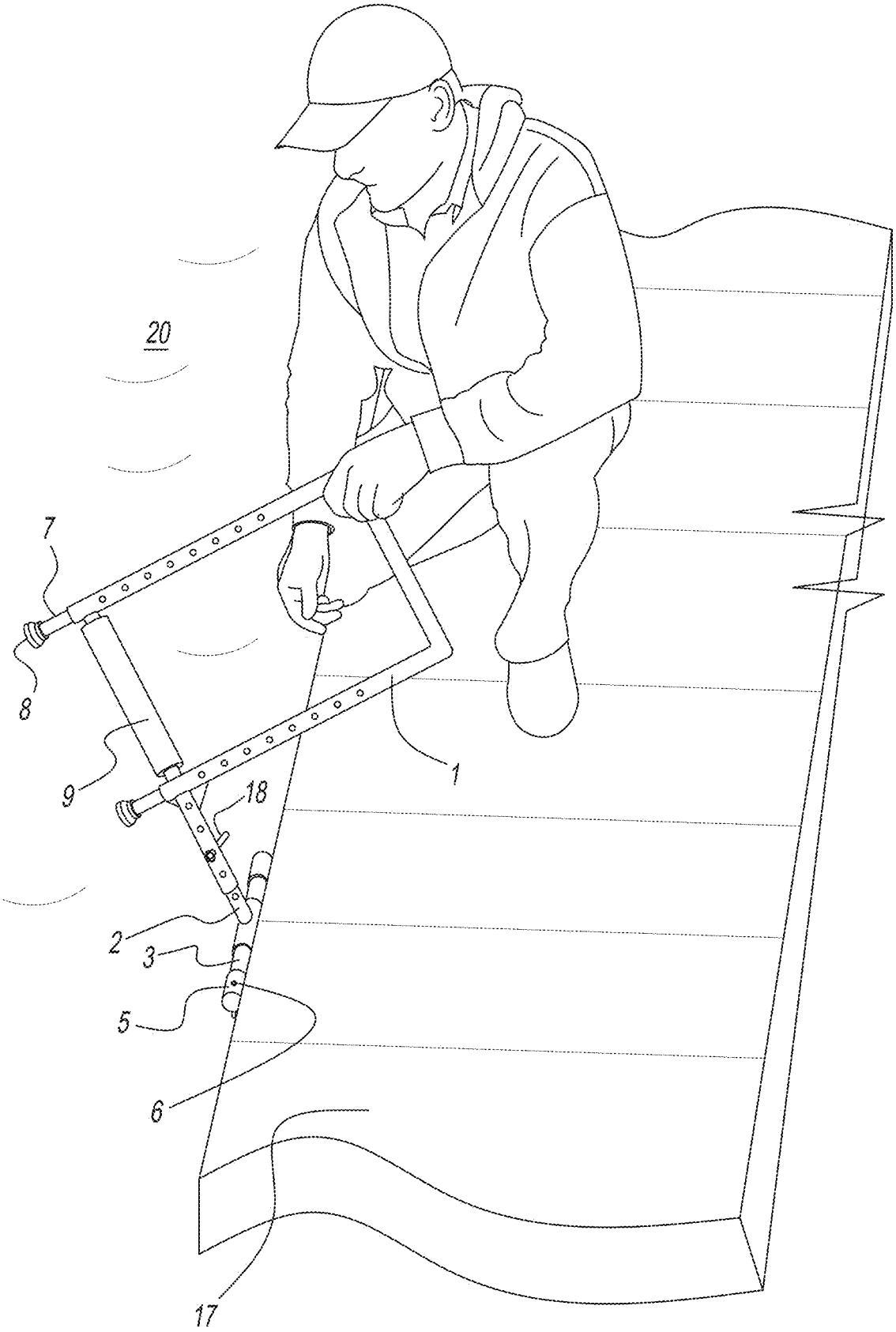
FIG. 4.—shows the device of FIG. 1 being rotated towards the water.

FIG. 4.—shows the embodiment rotating towards the water from its hinge point (3) fixed to the side of the dock (17). The embodiments rotation range is about 90 degrees from a horizontal stow position to full use position.

Figure 5:
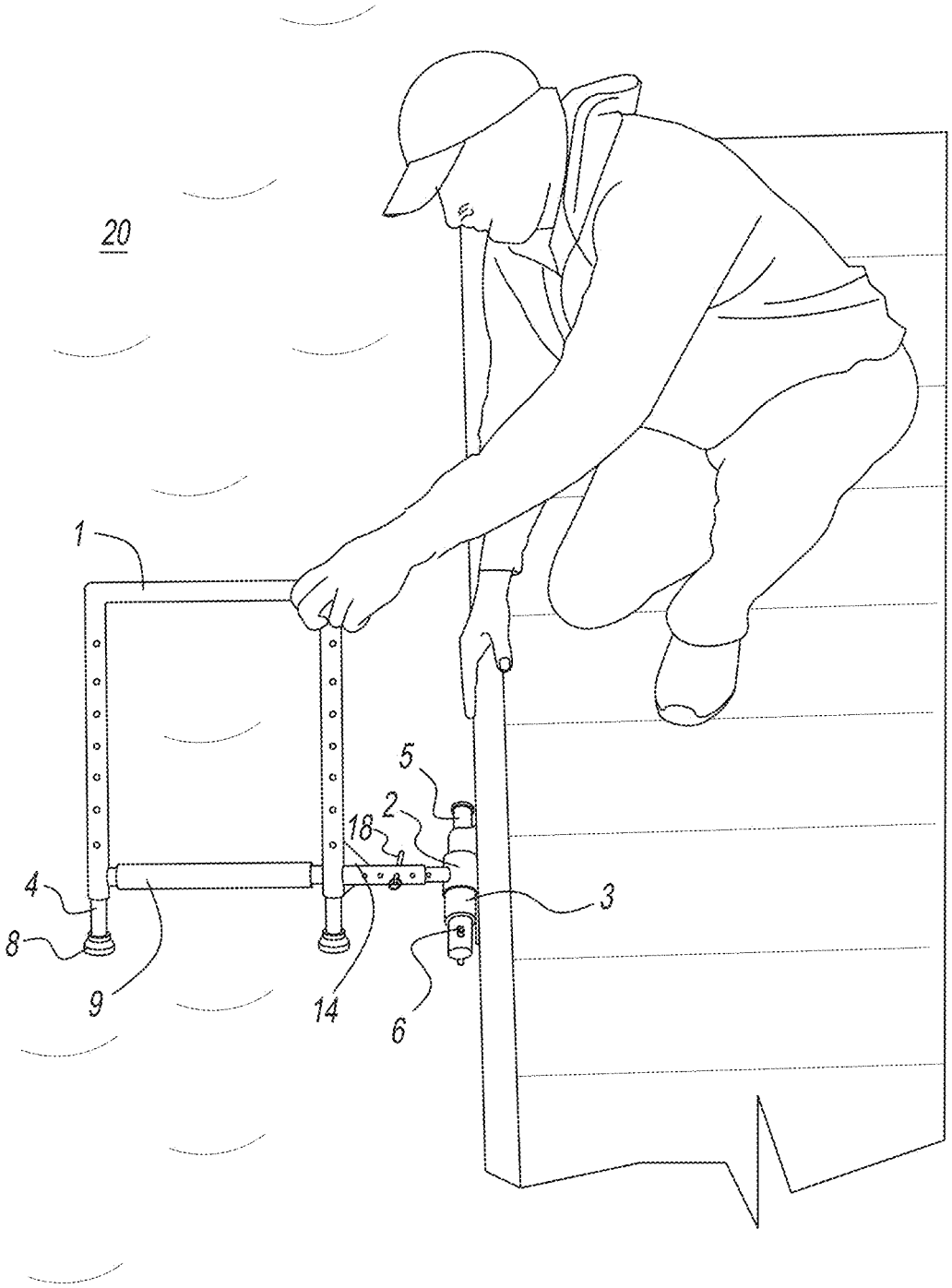
FIG. 5.—shows positioning of the device in full use mode.

FIG. 5. shows the embodiment can be adjusted to bring it further away or closer to the dock to accommodate a watercraft that is wider or narrower by pulling the safety/adjusting pin (18) between the pivot arm (2) and the main rectangular frame (1). It also shows the embodiment in the approximate area it should be when a user's full weight is applied while pushing against different types of personal watercraft by making vertical height adjustments to the main rectangular structure (1) by adjusting the straight legs/feet (4, 8), or if using the offset legs/feet (7, 8) in or out.

Figure 6:
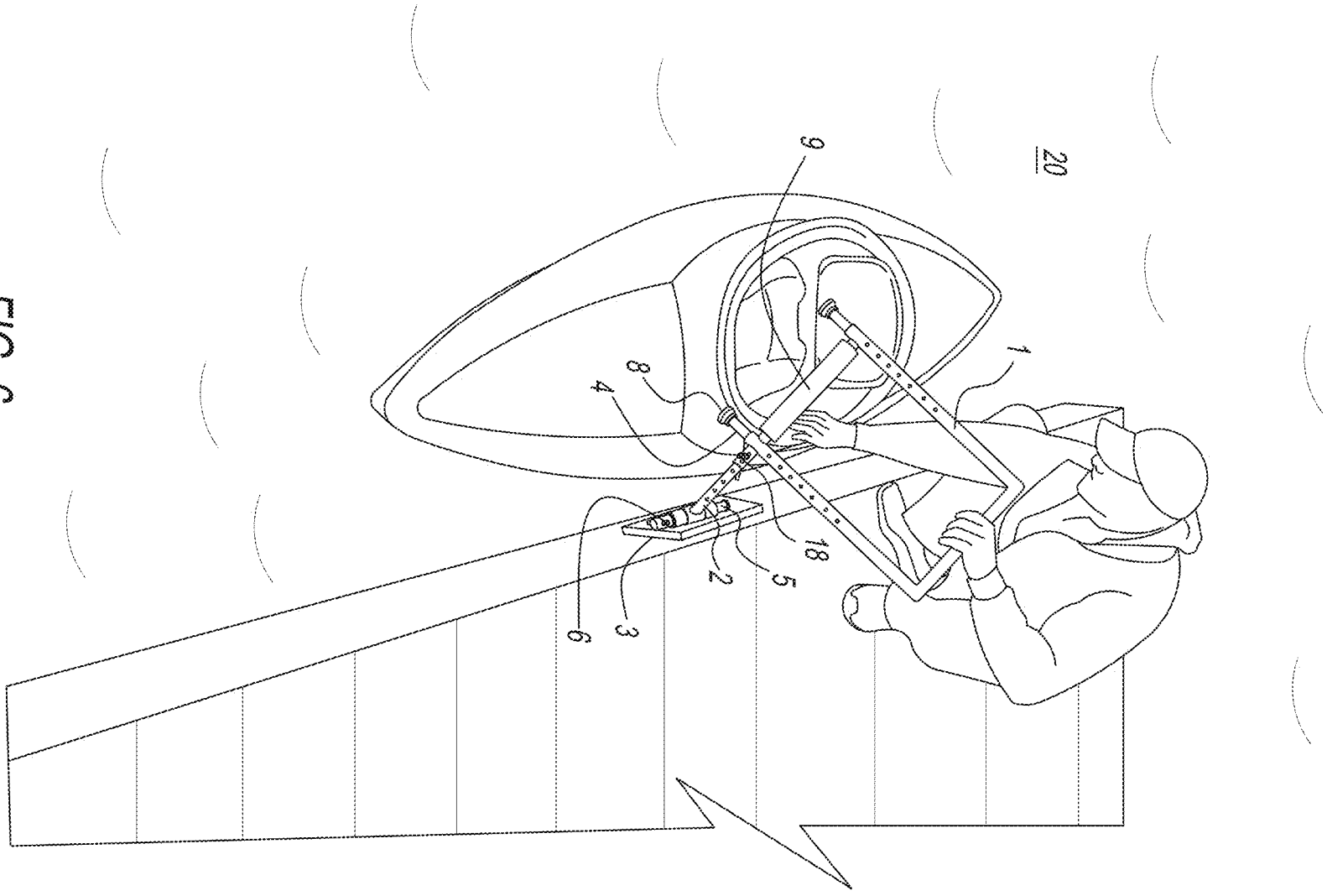
FIG. 6.—shows the device as the user lines up a kayak, or other watercraft, with the device.

FIG. 6.—shows the embodiment as the user lines up a kayak with the embodiment making initial contact with the leg/foot (4) of the embodiment to the kayak (approximately a 45 degree angle or less) to a chosen area on the kayak that is equally spaced to the other side kayak when the second leg/foot makes contact with that second portion of the kayak upper surface. This figure also indicates that the legs/feet (4) can be adjusted in or out vertically in order to accompany different types of personal watercraft such as a kayak, paddle board, canoe, etc., depending upon the watercrafts height off the water (20) when contact of the first leg/foot makes contact to watercraft used for the first time.

Figure 7:
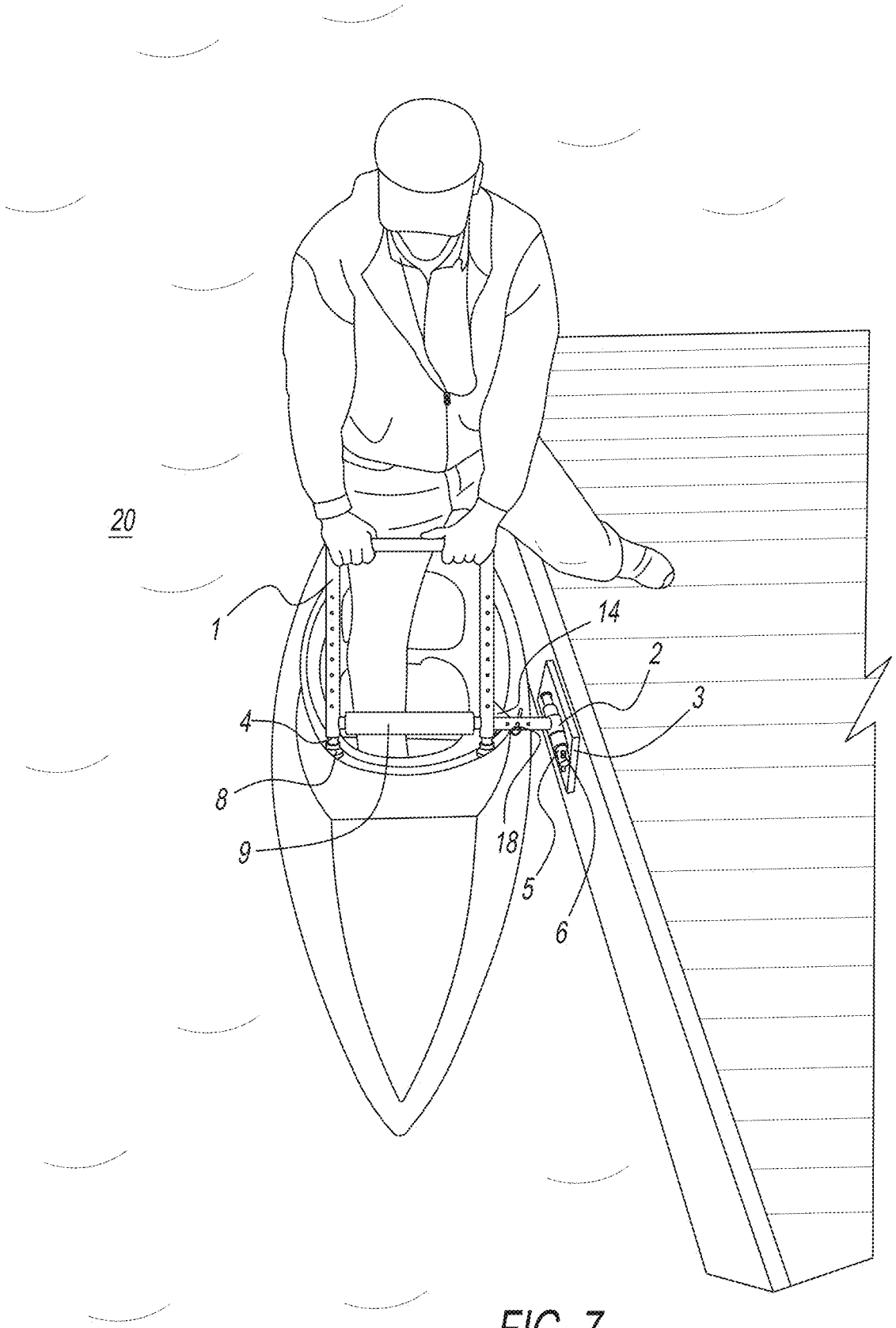
FIG. 7.—shows the user mounting the watercraft.

FIG. 7.—Shows the user placing both hands on the top bar of the embodiment and applying increased downward pressure as the user's body weight is being transferred from the dock to the embodiment frame (1) pushing the watercraft, against its inherent buoyancy, further into the water (20). This weight transfer has a stabilizing effect on the watercraft, and the user, while stepping onto the watercraft. A user then uses the padded lower horizontal bar (9) to place their knees or shins thereagainst to assist in kneeling down on, to sit down in, or continue standing depending upon the inner depth of the watercraft.

Figure 8:
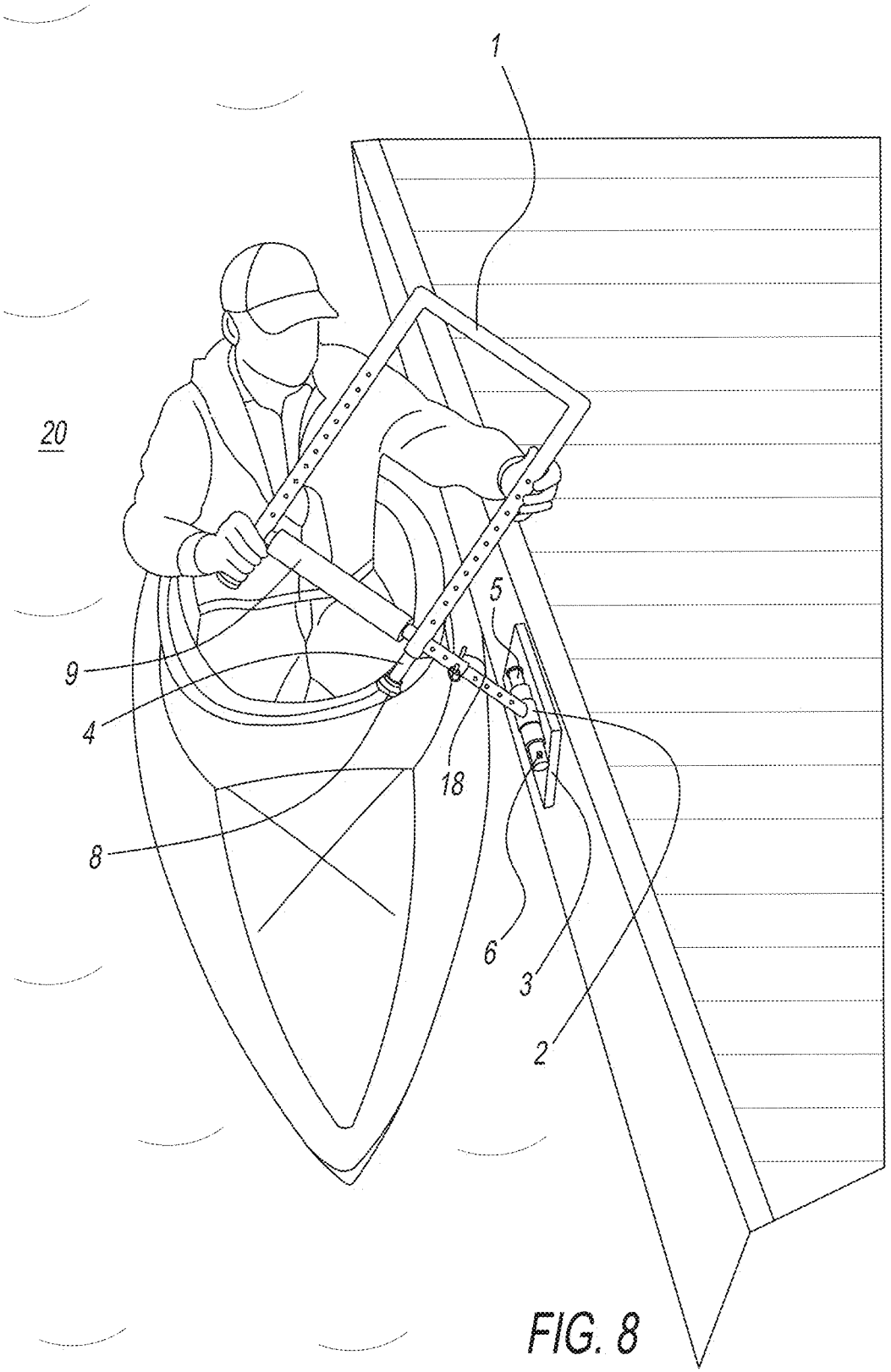
FIG. 8.—shows the user completely boarded rotating the device up and out of the way to a stow position.

FIG. 8.—shows the embodiment being rotated up and out of the way by the user to the stow position and getting ready to leave the area in the kayak. This figure also shows coming in and lining up the watercraft with the embodiment and putting the rectangular structures (1) legs/feet (4, 8) in place and getting ready to exit the watercraft.

Figure 9:
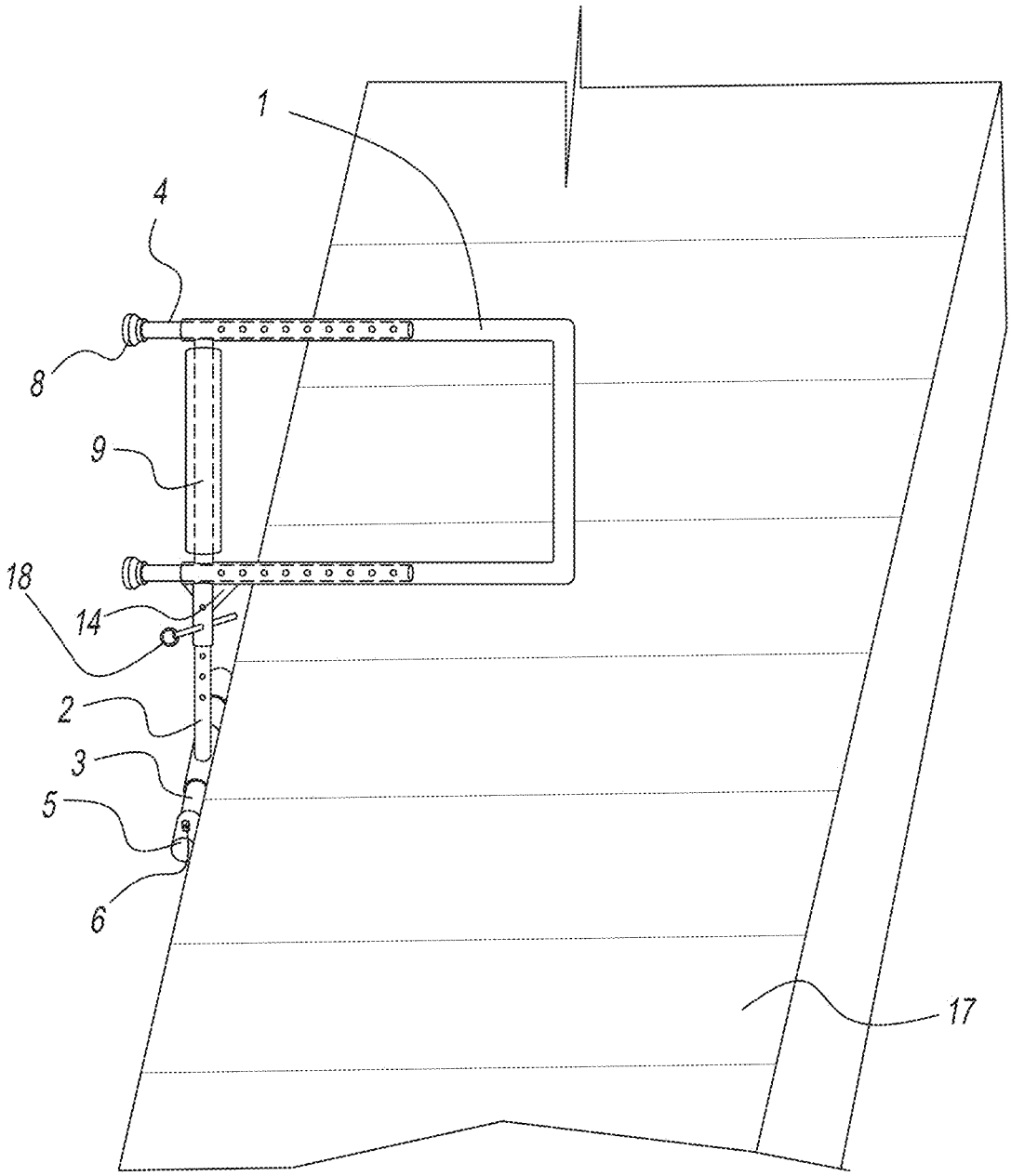
FIG. 9.—shows the device in a stowed position.

FIG. 9.—shows the embodiment in a stowed position without adjusting 90 degrees to the left or right to minimize dock space impedance while not being used.

Figure 10:
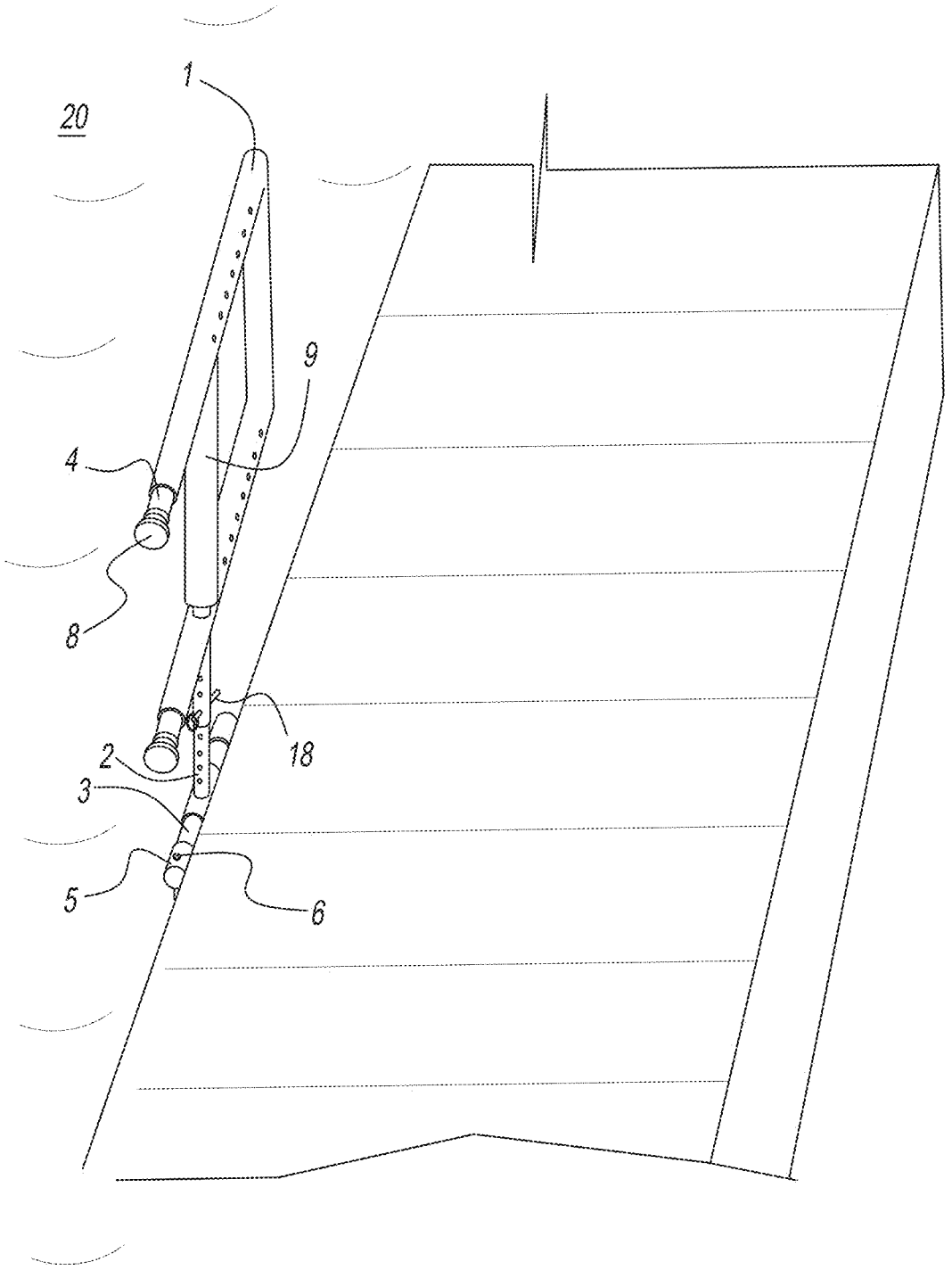
FIG. 10.—shows the device in a second stowed position.

FIG. 10.—shows the embodiment in a stowed position that does not impede any dock space by pulling the safety/adjusting pin (18) between the main rectangular structure (1) and the hinging arm (2) and turning it 90 degrees to either the left or right and re-pin it.

The hinging arm (2) can be configured from either round, square, rectangular, octagonal, hexagonal, or triangular tube of various types of metal, alloys, plastics, wood, composites, fiberglass, or paper of various sizes and dimensions. The hinging arm (2) connects the main rectangular structure (1) to the hinge plate (3). The round or square arm (2) tube, inserts into the main rectangular structure (1) off to one side preferably in-line with the lower bottom bar between the right and left sides of the rectangle, this optional feature allows adjustment horizontally for differing widths of watercraft in its "full use" positioning and for "stowing" purposes. In this embodiment it is secured by a small safety/adjusting pin (18).

The hinge plate (3) can be built from various types of metal, alloys, plastics, wood, hemp, composites, fiberglass, or paper of various sizes and dimensions. The hinge plate (3) connects to the hinging arm (2) which connects to the main rectangular structure (1). The hinge plate (3) is mounted by, for example, bolts (10, 11, 12, 13, or 16) to a solid structure like a dock (17) or boat platform, or to other bracket variations (like auxiliary mounting plate (15)) that could be made in order to accommodate the hinge plates (3) vertical mounting position within reasonable height location of the dock (17) or platform (17) to the ordinary/expected water level (20).

The optional straight legs (4) can be built from either round, square, rectangular, octagonal, hexagonal, or triangular tube of various types of metal, alloys, plastics, wood, hemp, composites, fiberglass, or paper of various sizes and dimensions. The optional version has the ability to adjust the straight legs (lengthen or shorten) vertically. This can be done by means of either a small safety/adjusting pin (18) or internal spring style push-in turn, push or pull to the new position, then the button pops back out on the main rectangular structure (1) to secure. The no adjustment option has the legs built as part of main rectangular structure (1), like the hinge arm (2), as a solid structure, with no provision for adjustments.

The connecting pin (5) can be built of various types of metal, alloys, plastics, wood, hemp, composites, fiberglass, or paper of various sizes and dimensions. The connecting pin (5) attaches the main rectangular structure (1) with its attached hinging arm (2) to the hinge plate (3). The cotter pin (6) can be made of steel, zinc plated steel, stainless steel or galvanized steel. The cotter pin (6) is simply used, in this embodiment, to secure connecting pin (5).

The offset style legs (7) are inserted into the main rectangular frame (1), and are fully adjustable in order to accommodate a wider or narrower contact area on upper surface shapes of the underlying watercraft. The offset leg (7) can be built from either round, square, rectangular, octagonal, hexagonal, or triangular tube of various types of metal, alloys, plastics, wood, hemp, composites, fiberglass, or paper of various sizes and dimensions.

The feet (8) can be made out of different types of foam products, cloths, soft plastics, rubber, and other weather resistant materials. The feet fit over the end of the adjustable straight legs (4) or offset legs (7) that make non-sliding contact to the surface of the watercraft.

The optional knee/shin pad (9) can be made out of different types of foam products, cloths, soft plastics, rubber, and other weather resistant materials. The cross-sectional views (FIG. 1) indicate where it belongs on the lower horizontal bar of the main rectangular structure. The knee/shin pad (9) fits on the lower horizontal section of the main rectangular structure (1), in this embodiment, to cushion the knees or shins during boarding and exiting in full use position.

The various hardware, 10, 11, 12, 13, 16 including bolts, nuts, washers, can be made of galvanized steel, stainless steel or zinc plated steel, in various sizes, strengths and lengths. These are variously used to attach the hinge plate (3) to a solid structure (17). The gussets 14 (two or more possibly used) are optional, depending on material used to build and stiffen the main rectangular structure (1) where the hinging arm (2) is inserted into the main rectangular structure's horizontal to vertical joint area.

The auxiliary mounting plate (15) is optional and, if needed, can be added to hinge plate (3) by welding, bolting, gluing or fusing for purpose of needing an alternative or supplemental structural element in order to secure the hinge plate (3) to the solid structure (17). The auxiliary mounting plate can be made from metal, alloys, plastics, wood, hemp, composites, fiberglass, or paper of various sizes and dimensions.

The solid structure (17) like a fixed post, a dock (floating or fixed), or a large boat's rear platform (stern) is necessary to mount the hinge plate (3) to along with auxiliary mounting plate (5) (if needed). The safety/adjusting pin (18), optional if needed, one to three used, can be made from metal, alloys, plastics, wood, hemp, composites, fiberglass, or paper of various sizes and dimensions. The safety/adjusting pin (18) is used for adjusting the main rectangular frame (1) connection to the hinging arm (2) with a safety chain attached to main rectangular structure (1) just in case the user drops the pin it will not be lost in the water rendering the unit useless until another pin is acquired to replace it. The same style pin can be used to adjust the straight legs (4) or the offset legs (7) in or out on the main rectangular structure (1).

FIG. 1 includes all of the parts and pieces relating to an embodiment of the invention. This version has a variety of options that can be added that will make it universal to its adaptability to varying conditions of water heights and styles of watercraft used. The non-optional feature equipped version would be exclusive to users that don't require any adjustment or need alternatives/changes; these would be custom built fixed installation applications. For example, a kayak excursion company out of non-tidal location that only supplies kayaks and where the water levels off the dock are consistent. The all-option universal model would be for the typical homeowners with a waterfront property, recreational parks or clubs that have multiple varieties of watercraft and solid structures.

As for mounting the invention to larger boats, for example a yacht that could accompany smaller watercraft like a kayak or paddleboard that would be launched off the stern of the vessel, the auxiliary mounting would have to be custom built for the application and would have different dimensions, mounting capabilities and designs to make the hinge-plate positioning adequate to directly attach the device to. The same principal would apply to an upright fixed post or any other unusual or uncustomary docks.

Method of Use for the Invention

The user will use one hand to line up the watercraft in the water (20) along with rotating the embodiment in the other hand towards the water making the feet of the embodiment come in contact with the watercraft ensuring that it is as close as possible to the front side of the weight and balance pocket of the watercraft and centered under the rectangular frame (1). The user will then apply pressure pushing downward using their own weight against the top of the rectangular frame with two hands as it hinges over (leveraged) making pressured contact with the watercraft ensuring that the embodiment is close to 80-90 degrees (shy of a right angle) compared to the hinge point (horizontally) or the deck (vertically), but, not too much beyond, otherwise the legs will need to be adjusted either in or out, then rechecked. Once the adjustments are satisfactory, the user continues to apply pressure as they push the watercraft into the water and continue to transfer their body weight towards the embodiment and watercraft pushing it even further into the water, thus stabilizing it. The user continues to hold downward pressure with two hands on the top horizontal bar and is stabilized as they start to step onto the watercraft with one foot, then the other, transferring all their weight onto the watercraft in a standing position. The user continues to hold on to the top horizontal bar with some downward pressure. The bottom bar between the rectangular frames right and left sides located in-line with the hinging arm (which is attached to the dock) is where the user puts their knees or shins against (a padded bar) as the user begins to kneel down to assist in (while holding onto the top bar with both hands) assuming a sit down or kneeling position, or continue standing if that is the desirable position for the watercraft being used. The process is reversed for exiting the watercraft: if sitting, line oneself up with the embodiment frame (1), rotate it over to make contact with the watercraft (because the user is already in the watercraft it is already weighted down, the embodiment is easily set to position against the watercraft), grab the top bar with both hands and pull yourself upward using the padded lower bar with your knees or shins for leverage and stability to a standing position. When standing (and continuing to have both hands on the top horizontal bar), take one foot out and step onto the dock then the other transferring weight away from the embodiment. Continue to rotate the embodiment away from the water 90 degrees to a stow position and then secure your watercraft.

NOTE: When adjusting the embodiment to accommodate the watercraft, it is important to get as close to the center of gravity as possible, within the weight and balance pocket of the watercraft. The higher the watercraft is above the water the higher the contact angle will be (up to 45 degrees with no pushing or weight applied), also the weight of the user needs to be taken into consideration so that the rotation of the main rectangular structure does not surpass 90 degrees, if at all, to the mounting plate or in other words the lower horizontal bar is close to parallel to the water, but not much over, otherwise the embodiments legs will need to be adjusted. The same principal applies for not enough weight or improper adjustment where watercraft is not pushed close enough to the 80 to 90 degree mark, simply re-adjust the embodiment. The lower the watercraft is to the waterline the further the legs must be adjusted outward and the less the contact angle will be (particularly for a paddleboard or the bottom (floor) of a canoe), care needs to be taken making large steps downward as to not force the watercraft out of the pocket by opposing force when making contact, step as straight down as possible. The same principal applies for exiting.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

The invention claimed is:

1. A watercraft entry and exit assist device, comprising:

a first hinge element configured for attachment to a structure;

a second hinge element, configured to connect and hinge with said first hinge element;

an arm element connected at a first end thereof to said second hinge element and adapted for hinging movement therewith; and, a rectangular frame structure, including respective sides and top and bottom bar portions connected there between to the respective sides, a second end of the arm element connected perpendicularly to one side of the respective sides of the frame structure, said frame structure including feet extending below said bottom portion, said feet being adapted for contacting an upper surface of a watercraft and bearing downwardly against said upper surface when said frame structure is rotated downwardly toward said watercraft using said first and second hinge elements, said frame structure configured to transfer body weight of a user to said watercraft via said hinging movement, and stabilizing said watercraft against said feet, during entry or exit from said watercraft.

2. A device as in claim 1, further comprising:

respective legs extending between each of said feet and said bottom portion.

3. A device as in claim 2, wherein said legs are adjustable in length.

4. A device as in claim 3, wherein said legs are adjustable in horizontal spacing one to the other.

5. A device as in claim 3, wherein said respective legs include an offset shape along their length wherein rotation of said legs alters said horizontal spacing.

6. A device as in claim 1, wherein said arm is adjustable in length so as to adjust the spacing between said second hinge element and said frame structure.

7. A device as in claim 6, wherein said arm is rotatable along its length with respect to said second hinge element.

8. A method of a user alighting a watercraft underlying a proximate structure, comprising the steps of:

aligning the watercraft along-side the structure so that a center of the watercraft is positioned beneath a downwardly rotated watercraft entry device, said device including: a first hinge element configured for attachment to said proximate structure, a second hinge element, configured to connect and hinge with said first hinge element; an arm element connected at a first end thereof to said second hinge element and adapted for hinging movement therewith; and, a rectangular frame structure, including respective sides and top and bottom bar portions connected there between to the respective sides, a second end of the arm element connected perpendicularly to one side of the respective sides of the frame structure, said frame structure including feet extending below said bottom portion;

contacting an upper surface of said watercraft with said feet;

said user, bearing downwardly on said frame structure and against said upper surface when said frame structure is rotated downwardly toward said watercraft from said proximate structure using said first and second hinge elements;

transferring body weight of said user to said watercraft via said hinging movement; and, stabilizing said watercraft against said feet, during entry or exit from said watercraft.

* * * * *